United States Patent [19]

Evans

[11] 3,952,654

[45] Apr. 27, 1976

[54] AUTOMATIC BLANKET WASH-UP SYSTEM

[76] Inventor: Robert E. Evans, 1205 Second Ave. S., Clinton, Iowa 52732

[22] Filed: Apr. 8, 1974

[21] Appl. No.: 459,096

[52] U.S. Cl. ..... 101/425; 15/256.51

[51] Int. Cl.[2] ..... B41L 41/00; B41L 41/06

[58] Field of Search ..... 101/423, 424, 425; 15/256.51, 256.52, 256.53, 256.5

[56] References Cited

UNITED STATES PATENTS

| | | | |
|---|---|---|---|
| 2,612,105 | 9/1952 | Skinner | 101/425 X |
| 2,704,029 | 3/1955 | George | 101/425 |
| 2,958,274 | 11/1960 | Ritzerfeed et al. | 101/425 X |
| 3,084,626 | 4/1963 | Stobb | 101/425 |
| 3,309,993 | 3/1967 | Grembecki et al. | 101/425 |
| 3,422,758 | 1/1969 | Brewster | 101/425 |
| 3,462,300 | 8/1969 | Hocutt | 101/425 X |
| 3,486,448 | 12/1969 | Anderson et al. | 101/425 |
| 3,611,926 | 10/1971 | Johnson | 101/425 X |
| 3,611,927 | 10/1971 | Johnson | 101/425 |
| 3,656,200 | 4/1972 | Riley, Jr. | 101/425 |
| 3,658,003 | 4/1972 | Johnson | 101/425 X |
| 3,737,940 | 6/1973 | Moestue | 101/425 X |
| 3,800,702 | 4/1974 | Roberts | 15/256.51 X |

*Primary Examiner*—Edgar S. Burr
*Assistant Examiner*—Paul J. Hirsch
*Attorney, Agent, or Firm*—Lowe, King, Price & Markva

[57] ABSTRACT

An attachment for cleaning cylindrical surfaces, such as the surface of an offset printing press blanket cylinder, includes a sponge unit mounted in proximity to the cylindrical surface to be cleaned. The sponge unit is supported by a pair of pneumatic cylinders which, when activated, cause the sponge to bear in wiping engagement against the cylinder. A single elongated spray tube containing two sets of orifices, one set facing the sponge unit and the other set facing the cylinder, is mounted on the sponge unit and connected to a source of cleaning solvent under pressure. During a cleaning operation, the solvent is directed through the orifices of the spray tube toward both the sponge unit and the cylindrical surface adjacent the nip. The concentration of the solvent spray at this location results in the sponge cleaning the cylindrical surface without streaking. The sponge unit mounts on an elongated angle bracket and the spray tube is in turn mounted on the sponge unit. A plurality of screw and wing nut assemblies is used to mount the sponge and spray tube to permit a quick release and disassembly of the apparatus for maintenance. An upstanding shield isolates the cleaning attachment from the remainder of the press to prevent any flying particles from contaminating the ink roller system. An integrated control system provides simultaneous presurization of the solvent reservoir, the spray apparatus and the pair of cylinders that move the sponge against the surface.

5 Claims, 6 Drawing Figures

AUTOMATIC BLANKET WASH-UP SYSTEM

FIELD OF THE INVENTION

The present invention relates generally to a cleaning attachment for a cylindrical surface and more particularly to a cleaning attachment for automatically cleaning the blanket cylinder in an offset printing press.

BACKGROUND OF THE INVENTION

One of the most widely used pieces of equipment used in a newspaper or commercial printing operation is a high-speed web offset press. Generally, these offset presses have three cylinders: (1) a plate cylinder to which the plate carrying the image is secured; (2) a blanket cylinder covered with a rubber sheet or blanket and a tangential engagement with the plate to receive from the plate the inked portions of the image; and (3) an impression cylinder in contact with the blanket cylinder. The paper passes between the latter two cylinders at the nip between said cylinders to receive the printed image from the blanket cylinder. When printing on both sides, the blanket cylinder of one printing cylinder combination may serve as the impression cylinder of the opposing combination.

In an offset press running at speeds of 15,000 to 60,000 impressions per hour and printing on, for example, 32 pound newsprint stock, the accumulation of lint from the paper stock, and a combination of ink and water on the blanket soon causes a deleterious build-up of foreign matter. This build-up tends to distort the image area and printed unwanted images on the paper. When the point is reached where the reproductive quality falls below the acceptable standard, an inferior printed product is produced and wastage inevitably occurs.

In the past, one solution to the problem of foreign matter or dirt buildup has been for an operator to periodically stop the press when the build-up has reached a critical stage, and manually, with a cleaning solvent and rag, wash the blanket of each printing couple. The problem with manually washing the blanket is that the rag leaves streaks due to inconsistent solvent application and unequal pressure. Also, valuable minutes of daily production are wasted while the press is idle.

Generally, this problem has been dealt with by stop gap measures. For example, the printing press is operated at a slow speed and a solvent soaked cleaning rag is held against the blanket while the press is operating. However, this is a highly dangerous method because an operator is likely to get his hand caught, especially while maneuvering the rag in the vicinity of the pressure nip between the cylinders. In addition, the equipment itself can be damaged by the loose rag becoming entangled in the press. Furthermore, because web newsprint continues through the printing press, relatively large amount of spoiled paper stock results.

In order to improve the efficiency of operation of the offset press and to help protect the operator from injury, several types of automatic blanket cleaning systems have been proposed for incorporation in the presses. For example, in one type of automatic system, a cleaning unit is installed on the underside of each printing unit to automatically apply a fine mist spray of cleaning solvent to the blanket or printing surface. This solvent causes the build-up on each blanket cylinder to be broken up and then carried away on a sheet of newsprint. However, this unit, as is obvious, also causes a substantial amount of paper to be wasted as the blanket is being cleaned. Further, this prior art is not effective against the ground-in dirt since there is no scrubbing action.

In another type of automatic system, a roller shaped cleaning tool is applied against the cylindrical surface of the blanket cylinder to be cleaned. A plurality of spray nozzles in proximity to the cylindrical surface apply an atmosphere of atomized cleaning liquid against the surface. Because of the induced atomization, the "misting" problem is paramount and an enclosure must be provided. A vacuum system draws off the atmosphere containing the cleaning solvent and some entrapped dirt. A separate spray nozzle is provided to apply a cleaning liquid to the rotating cleaning tool, which is, in turn, squeezed by a roller.

This automatic cleaning apparatus has the disadvantage of requiring a number of separate spray nozzles. The original cost of the hardware and the relatively large amount of solvent needed make the system very expensive to install and operate. Further, the cleaning solvent tends to be applied to the cylinder and cleaning tool unevenly and without being accompanied by immediate scrubbing and wiping action on the cylindrical surface adjacent the pressure nip. Streaks are produced on the cylinder as the cylinder is rotated because of this uneven distribution of the solvent and drying of the solvent by the large volume of air sucked into the enclosure by the vacuum system. In addition, since the squeeze roller pushes on the roller, the tendency is for the dirt trapped in the roller to be worked up to the surface and reapplied to the cylinder. The roller tools are inconvenient to remove and require a substantial amount of time and effort on the part of the operator.

Finally, in the past the economic pressure to develop an improved automatic blanket cleaning system has not been as great as it is today. Since the operator had to stop the press to splice the newsprint web anyway, most companies have opted not to purchase the previous automatic systems but to stick with the manual cleaning. Today, with automatic web splicing equipment being installed on virtually all of the presses, an efficient and inexpensive automatic cleaning system is needed more than ever.

OBJECTIVES OF THE INVENTION

Accordingly, it is to one object of the present invention to overcome above cited objections and to provide a cleaning apparatus for a cylindrical surface, such as the cylinder blanket in an offset printing machine, of an improved design.

It is another object of the present invention to provide a new and improved cleaning apparatus for a cylindrical surface which provides an improved cleaning of a cylinder blanket without causing streaks.

It is still another object of the present invention to provide a new and improved cleaning apparatus for a cylindrical surface which provides a uniform application of a cleaning solvent to both the cylindrical surface being cleaned and the sponge unit that scrubs and wipes the surface adjacent the pressure nip between the same.

It is yet another object of the present invention to provide a new and improved cleaning apparatus for a cylindrical surface requiring only a single spray tube for applying cleaning fluid both to the cylinder to be cleaned and to the sponge unit.

It is still another object of the present invention to provide a new and improved cleaning apparatus for a cylindrical surface, such as a blanket of an offset printing machine, which apparatus includes a sponge unit and spray tube which are easily removed and replaced for maintenance.

It is another object of the present invention to provide a new and improved cleaning apparatus which delivers an even distribution of cleaning solvent to the outer surface of a blanket cylinder in an offset press to obviate streaking.

It is yet another object of the present invention to provide a new and improved cleaning apparatus for a cylinder surface which is economical to operate, easy to manufacture and convenient to install.

BRIEF DESCRIPTION OF THE INVENTION

A cleaning attachment for the blanket of an offset press is provided having a frame which is attached to the main frame of the press and supported in proximity to a cylindrical blanket along the axis thereof. As there may be two blanket surfaces associated with each offset press for simultaneous printing on both sides, it is understood that two such cleaning attachments are generally provided for each press.

Affixed to each cleaning apparatus frame are two pneumatic cylinders which support a sponge unit over the outer surface of the cylindrical blanket. In response to a control signal, the cylinders are actuated to move the sponge unit into operative wiping engagement with the surface to be cleaned.

A single elongated spray tube is connected to the sponge unit and is attached to a source of cleaning solvent maintained under pneumatic pressure. Advantageously, the pneumatic cylinders which support the sponge unit are connected to the same source of compressed air that sprays the solvent so that the pneumatic cylinders are actuated simultaneously with the initiation of the spraying function. The spray tube is supported in proximity to both the sponge and the cylindrical blanket. The tube contains two sets of orifices; one set being directed toward the blanket and the other set being directed toward the sponge unit. The cleaning solvent sprayed from the spray tube impinges on both the sponge unit and cylindrical blanket adjacent the pressure nip. Because the orifices are uniformly distributed on the spray tube, the sponge unit and blanket are uniformly covered with the cleaning solvent. With the equal pressure along the length of the sponge unit assured by a support bracket attached to the operating piston rods of the pneumatic cylinders, there is an additional safeguard against streaking of the surface of the blanket, as has been a problem in the past.

The sponge unit also includes an elongated holder mating with the support bracket and providing still further support along the full length of the sponge. The uniform resiliency of the sponge also helps to maintain constant and equal cleaning pressure to further assure against streaking. The sponge unit is fastened to the angle-shaped support bracket with a plurality of screw and wing nut assemblies so that the entire sponge unit may be easily removed for cleaning or replacement. In addition, the spray tube is connected to the sponge unit with a plurality of screw and wing nut assemblies so that the tube may be easily removed from the sponge unit. Important additional support is given to the sponge by the bar extending along the face of the sponge and supporting the spray tube.

The entire package of the cleaning apparatus of the present invention also includes upstanding shields to catch my particles of solvent and dirt flying from the surface by centrifugal force. This obviates the need for confining enclosure and expensive vacuum systems required in the prior art. Also included is a simplified control system where all of the functions required for cleaning are integrated into one unit. Reliable pneumatic motive force is used to assure simultaneous performance of all functions, that is, sponge movement, spraying and solvent feeding. Activation of the system is preferably timed in accordance with the established need of a particular press; however, sensing of foreign matter build-up and manual activation are also contemplated.

Still other objects and advantages of the present invention will become readily apparent to those skilled in the art from the following detailed descriptions, wherein is shown and described only the preferred embodiment of the invention, simply by way of illustration the best mode contemplated of carrying out the invention. As will be realized, the invention is capable of other and different embodiments, and its several details are capable of modification in various obvious respects, all without departing from the invention. Accordingly, the drawings and description are to be regarded as illustrative in nature and not as restrictive.

DETAILED DESCRIPTION OF THE PREFERRED EMBODIMENT

Figures 1, 6:
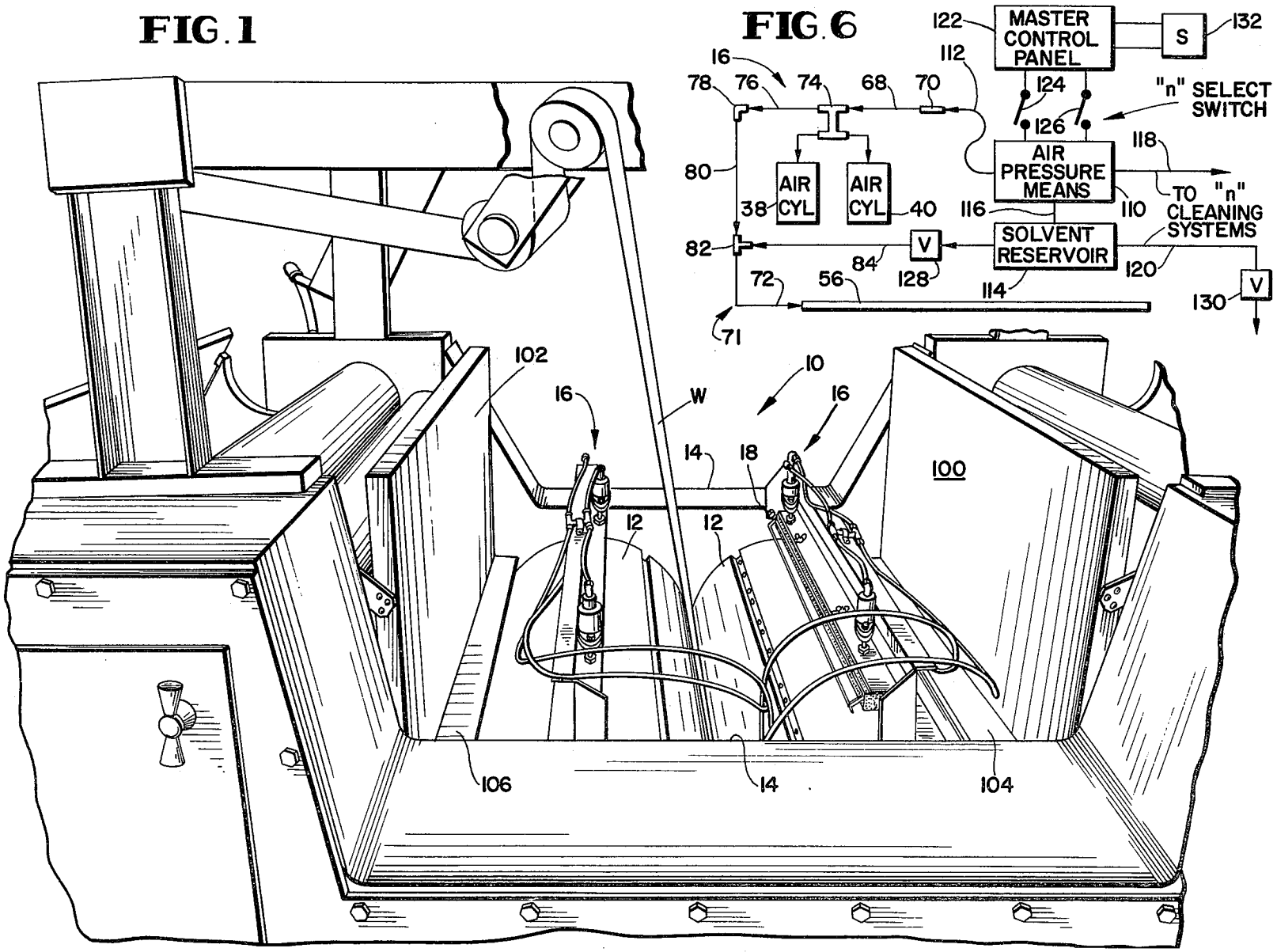
FIG. 1 is a perspective view of an offset press upon which is mounted the cleaning apparatus of the present invention.
FIG. 6 is a schematic diagram of the cleaning apparatus of the present invention including the control system.

Referring now to the drawings, wherein like reference numerals designate identical, or corresponding parts throughout the several views, and more particularly to FIG. 1, an offset printing press 10 is shown including a pair of blanket cylinders 12 journalled to the outer walls or main frame 14 of the press 10. Also supported by the walls 14 is a pair of identical cleaning attachments 16 according to the present invention. These attachments 16 may be supported in proximity to the blanket cylinders 12 parallel to the axis thereof by any suitable means, such as plurality of mounting bolts 18 (only one shown, for illustration, FIG. 1). A web W passes between the cylinders 12 to be printed.

Figure 2:
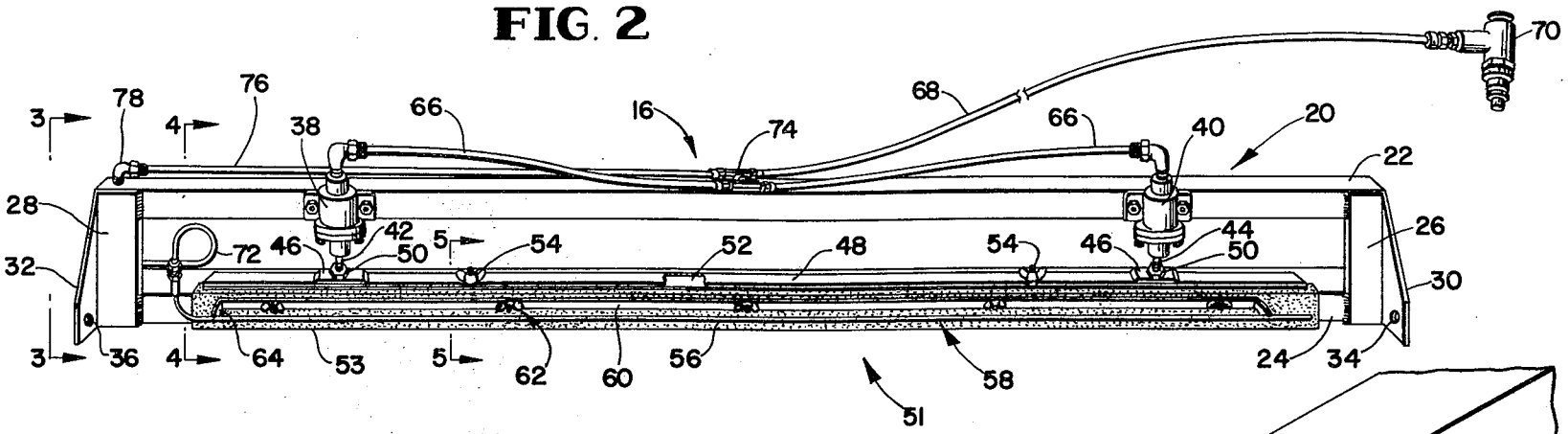
FIG. 2 is a perspective view of the cleaning apparatus of FIG. 1 and in accordance with the present invention.

Referring to FIG. 2, the cleaning attachment 16 comprises an elongated frame 20 formed of upper and lower frame bars 22 and 24 maintained in a parallel, spaced apart relationship by a pair of angle brackets 26 and 28. The brackets 26 and 28 are preferably welded to the frame bars 22 and 24; however, other means, such as bolting can be used if desired. Each angle bracket 26 and 28 includes, as one leg thereof, a support gusset portion 30 and 32, respectively. Apertures 34 and 36 (FIGS. 2–4) are formed in the support portions 30 and 32, respectively, through which the mounting bolts 18 pass. Slots 34*a*, 36*a* in the ends of lower bar 24 allow initial supporting of the cleaning attachment 16 on the walls 14 by separate bolts (not shown) and provide anchor points when the bolts are tightened.

A pair of pneumatic cylinders 38 and 40 are fastened to the frame bar 22 and are positioned with piston rods 42 and 44 facing the frame bar 24. The lower portions of the rods are threaded for engagement with a tapped bore (not shown) in a raised portion 46 of an angle bracket 48. A lock nut 50 is supported on the threaded portion of each rod 42, 44 and is tightened to bear against the raised portion 46.

A sponge unit 51, constructed in accordance with the invention, includes the elongated angle holder 52 and a mating elongated sponge 53. The unit 51 is held on the bracket 48 by a pair of screw and winged nut assemblies 54, which will be described in more detail later.

An elongated spray tube 56 is supported by the sponge unit 51 on an elongated spray tube mounting bracket 58. The mounting bracket 58 includes a central bar portion 60 seated against the surface of the sponge unit 52 and secured thereto with a plurality of screw and winged nut assemblies 62. End support portions 64 include a slotted end for snap locking the spray tube 56 into position.

Two tube sections 66 are connected to the pneumatic cylinders 38 and 40, which are thus supplied with compressed air by way of a supply tube 68. The supply tube 68 is connected to a source of compressed air by way of a connector 70, which may be a spring biased, quick connect type. The connector 70 serves to interconnect the attachment 16 to the control system to be described in conjunction with FIG. 6. When the cylinders 38, 40 are activated, the sponge unit 51 moves against the surface of the cylinder forming a pressure nip, as will be further described in conjunction with FIG. 5.

Figure 3:
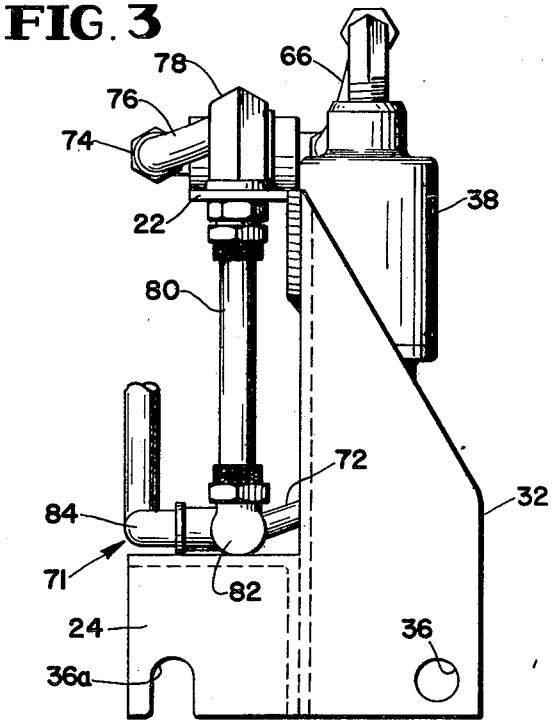
FIG. 3 is a side view of the cleaning apparatus shown in FIG. 2.

The supply tube 68 also supplies the compressed air to solvent feeder means 71 (FIGS. 3 and 6). As noted in FIG. 3, the feeder means 71 may be positioned adjacent the angle bracket 28 and has a feed tube 84 to allow constant replenishment of the solvent liquid. Preferably by mixing of the two high pressure streams in Y-connector 82, high pressure solvent spray is provided through connecting tube 72 to the spray tube 56.

The compressed air applied to the tubes 66 for operation of the pneumatic cylinders 38 and 40, is also fed directly to the described spray system. This occurs through a pair of T-couplings, 74, line 76 and elbow 78, all mounted on top of the attachment assembly (FIGS. 2 and 3). Transfer line 80 (FIG. 3) finally interconnects the elbow 78 to the Y-connector 82 (see FIG. 6 also).

While the tubes 66, the supply tube 68, the line 76 and the line 80 may alternatively be formed either of a flexible material, such as polyethylene, or a rigid material, such as copper, the tube 72 which supplies cleaning solvent under pressure to the spray tube 56 must be formed of a flexible material in order to permit the spray tube 56 to move downwardly toward the blanket cylinder 12 under the motive force of the pneumatic cylinders 38 and 40.

Figure 4:
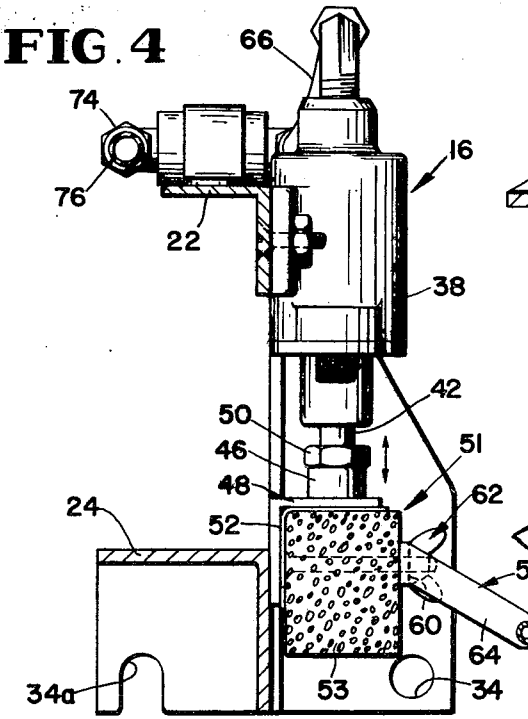
FIG. 4 is a sectional view of the cleaning apparatus taken along the line 4—4 in FIG. 2.

FIG. 4 is a cross-sectional view of the cleaning attachment 16 showing one end of the sponge unit 51 mounted on the angle bracket 48, in turn supported by the piston rod 42 of the pneumatic cylinder 38. The spray tube 56 is supported by the spray tube mounting bracket 58 which is directly supported by the sponge unit 51 by a plurality of screw and wing nut assemblies 62, shown in more detail in FIG. 5. In FIG. 4, the cleaning attachment is shown in its raised or deactivated position with respect to the bar 24 wherein the sponge unit 51 and spray tube 56 are maintained over but not in contact with the cylindrical blanket 10.

Figure 5:
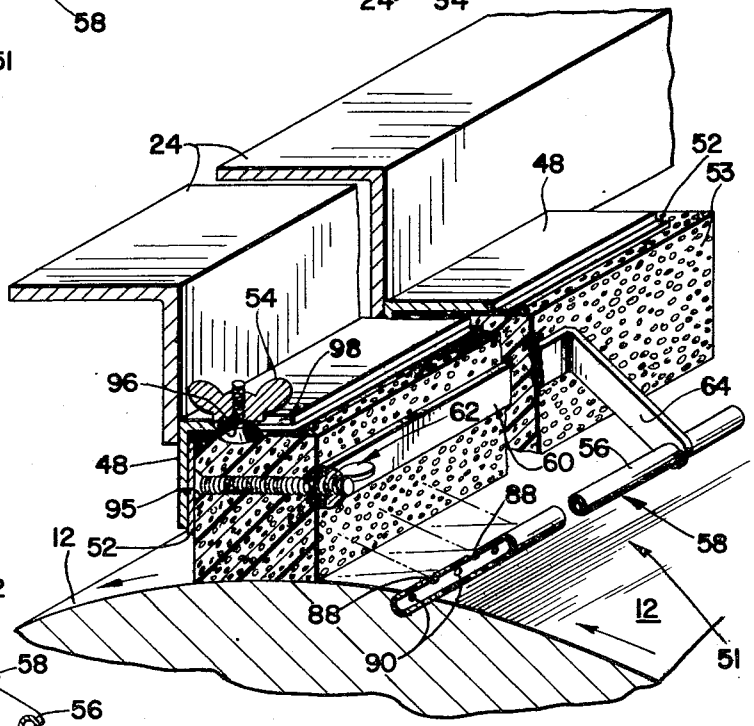
FIG. 5 is an enlarged partial perspective view taken in cross section (lines 4—4) of the sponge unit in wiping engagement with the cylindrical surface and the spray tube directing the cleaning solvent toward the surface and sponge unit adjacent the pressure nip.

In FIG. 5, the cleaning attachment is shown installed on the press 10 and in its activated position of operation. The pneumatic cylinders 38 and 40 (not shown in this figure) are in an activated mode so that the sponge unit 51 is maintained against the surface of the cylinder 10 and the bottom of the sponge 53 form a pressure nip 92 against the surface of the cylinder 12. The cleaning solvent is forced by the compressed air to enter the spray tube 56 to impinge against the sponge unit 51 and the cylinder 10 through two sets of orifices in the spray tube 56.

More particularly, the spray tube 56 contains two sets of orifices 88 and 90. The set of orifices 88 consists of alternate orifices along the surface of the spray tube 56, all of which are positioned on the surface to face the lower edge of the sponges 53. The set of orifices 90 consists of the remaining orifices on the spray tube which are arranged to face the surface of the blanket cylinder 10 adjacent the nip 92. The blanket cylinder 10 rotates in the direction of the arrow in FIG. 5 and the spray tube 56 is mounted just upstream of the nip 92. Accordingly, during actuation of the cleaning attachment, cleaning solvent is sprayed against both the sponge 53 and the blanket cylinder 10 and the saturated sponge loosens the dirt and wipes the surface clean. A substantial portion of the loosened dirt and the solvent is retained in the sponge 53 so that it is not likely to reattach to the blanket downstream.

The elongated sponge holder 52 has a recessed aperture 95 corresponding to the head of each screw of the screw and wing nut assembly 62. The aperture is recessed so that the screw head associated with each assembly 62 does not interfere with the angle bracket 48. This forms the basic support means for the sponge 53.

The sponge holder 52 also includes a plurality of recessed apertures 96 in the top into which are positioned heads of the screw portions of the screw and nut assemblies 54, one of which is shown in FIG. 5. The positions of the fastener assemblies 54 coincide with outwardly extending open-ended slots 98 formed in the angle bracket 48.

It can now be realized that the cleaning attachment or head 16 to be used with the system of the present invention is characterized by its simplicity and its improved functional concepts. The spray tube 56 is effective to provide a concentration of solvent liquid adjacent the pressure nip between the sponge 53 and the blanket surface 12.

The sponge 53 is mounted securely on the bracket 48 so that it can scrub and wipe the surface as the solvent is being applied.

The sponge 53 is further stabilized against the forces that act on it during the rotation of the blanket 12 by the bar portion 60 of bracket 48. Also the angle holder 52 securely mates with the bracket 48 and thereby provides reinforcement.

The application of solvent through apertures 88 to the lower edge face of the sponge 53 maintains the same in a saturated condition so that starving and the resultant streaking is minimized. The second set of apertures 90 applies the solvent directly against the blanket 12 so that the foreign matter is contacted directly and effectively loosened to be taken up by the sponge 53.

Sponge 53 is conveniently held in position for quick release by the fastener means or nut and bolt assemblies 62. All that needs to be done to remove the sponge 53 for cleaning or replacement is to remove the wing nuts, pull off the bracket 58 including the bar portion 60 and slide the sponge outwardly (FIG. 4). If the entire sponge unit 51 is desired to be removed, the wing nuts of the fastener assemblies 54 may be loosened and the entire assembly moved forward utilizing the slots 98 in the angle bracket 48 (see FIG. 5).

The sponge 53 receives and absorbs a substantial amount of the solvent and dissolved foreign matter, including ink, water and lint. However, as will also be realized by those skilled in the art, a portion of the loosened foreign matter proceeds around the blanket 12 and is taken up by moving web W (see FIG. 1).

The effectiveness of the spray arrangement just upstream of the pressure nip, the use of the pneumatic pressure in the cylinders 38, to resiliently urge the sponge 53 against the surface to form said nip, and the resilient sponge firmly held in position against the surface, assures a very efficient wiping operation. Thus, the duration of the entire cleaning operation may normally be in the range of only 4–12 seconds. And as a result, the web footage that is wasted to help in the cleaning operation by absorbing the residue solvent and foreign matter is minimized.

In addition to the absorption of solvent and foreign matter by the sponge 53 and the residue pick-up by the web W, it is inevitable that in between these two points, some of the particles are thrown free of the rotating blanket by centrifugal force. This flying mist is advantageously controlled by providing upstanding shields 100, 102, as shown in FIG. 1. These shields may be mounted for quick release by standard fasteners for servicing. The shields 100, 102 are mounted in front of the ink roller system and above the blankets 12. The misting occurs just behind the attachment 16. Following the tangent from the point of the pressure nip 92 (FIG. 5), the solvent dissolved ink, lint and all other foreign matter not caught by the sponge 53 is intercepted by the shields and not thrown into the inking system. Ledges 104, 106 are provided to catch the material that runs down and directs it to the side of the press at a convenient collection point.

The system of the present invention is suited for installation in a printing plant having any number of presses. The printing press 10 illustrates a typical set-up for a single press operation. The attachment 16 and the shields 100, 102 are identical for each printing combination or couple and may be provided in kit form along with the control circuitry for conversion of virtually any make or model press.

In the control circuit, FIG. 6, air pressure means, which may include a conventional air compressor and reservoir 110 connects by supply line 112 to the coupling 70 of the attachment 16. When the line 112 is provided with pneumatic pressure, the air cylinders 38, 40 are actuated, and simultaneously, the pressure at solvent feeding means 71 (including Y-connector 82) is effective to supply the solvent to feed tube 56. The solvent comes to the Y-connector 82 through line 84 under pneumatic head pressure from solvent reservoir 114; the pressurization being provided by connection 116 directly from the air pressure means 110. Mixing of air and solvent at connector 82 assures high velocity ejection from spray tube 56 to enhance the cleaning operation.

For each additional number *n* cleaning systems including the second attachment 16 shown in FIG. 1, corresponding air line 118 and solvent line 120 are provided in accordance with the invention. In other words, if a plant has 20 printing combinations or couples, then there are 20 separate air and solvent supplies running to the individual cleaning systems.

As mentioned above, it is contemplated that the operation of the system may be automatic, such as on a time-sequenced basis, or in response to sensors reading the face of the cylinders 12 to determine when the foreign matter build-up is critical. A master control panel 122 within the state-of-the-art is provided under such conditions and completely frees the press operator under normal conditions of any need to monitor the build-up. The master control panel may alternatively be operated manually by the press operator simply by operating master control switch 132.

A plurality of toggle switches selects those printing couples that are being used. Thus, a select switch 124 is positioned at the interface between the master control panel 122 and the air pressure means 110. This switch 124 can be for the first attachment 16, and any number of additional *n* select switches 126 are then provided for each of the other systems. At start-up, the operator merely engages those select switches 124, 126 needed. The switches 124, 126 may also be interconnected to solenoid valves, 128, 130 to control the pressure feeding of the solvent in lines 84, 120.

With each of the select switches 124, 126 properly set, only those printing couples in use will be sprayed with solvent and cleaned. In this way, an idle printing couple is not sprayed. This avoids not only wastage of solvent, but also, the uncontrolled deposit of solvent in the press where it is not ready to be immediately removed by the sponges 53 and the web W.

All of the connected attachments 16 in the *n* cleaning systems that are activated provide simultaneous cleaning. Each of the webs W . . . $W_n$, going through the press or presses at the time pick up the residue from the blankets 12 and carry the same out of the press for disposal, as described above. With all of the webs W . . . $W_n$, arriving at the folder (not shown) of the printing set-up at the same time, substantial savings in terms of time to collect the wastage paper is realized. Furthermore, it should be remembered that the duration of the cleaning cycle needed with the apparatus of the present invention minimizes the amount of paper going through.

In summary, the cleaning system of the present invention, including the cleaning attachment 16 provides substantial efficiencies and benefits that were heretofore not obtainable. A provision of a single elongated spray tube adjacent the pressure nip to spray solvent on the sponge member and the blanket simultaneously provides maximum cleaning and efficiency. The simplicity of the structure is of importance since now automatic or semiautomatic wash-up may be economically provided on all presses. Today, when automatic splicing equipment is being installed on all equipment, this is of even more importance that it has been in the past. The air pressure actuation of the sponge unit 51, the inherent resiliency and static condition of the sponge 53 once in operative position, and the stability of the sponge due to the particular fastening structure, all adds together to give the exceptional performance of the present cleaning system.

The control system of FIG. 6 provides the solvent under positive pressure to the spray tube 56 and simultaneously serves to actuate the cylinders 38, 40, thus coordinating the two major functions of the system. Each printing couple may be individually selected. Thus, no cleaning is performed at a station where there is no sponge and web to absorb the residue and solvent is not wasted.

In this disclosure, there is shown and described only the preferred embodiment of the invention, but as aforementioned, it is to be understood that the invention is capable of use in various other combinations and environment and is capable of changes or modifications within the scope of the inventive concept as expressed herein.

What is claimed is:

1. A cleaning attachment for a cylindrical surface, such as a blanket cylinder in an offset printing press, comprising:

an elongated frame adapted for mounting adjacent said cylindrical surface parallel to the axis of said cylinder;

a sponge;

actuating means mounted on said frame to support and move said sponge into engaging pressure wiping relationship with said cylindrical surface to form a presssure nip;

a single elongated spray tube means supported adjacent said sponge just upstream of said pressure nip and substantially parallel thereto, said spray tube means having a plurality of orifices directed to dispense a spray of said cleaning solvent adjacent said pressure nip against both said sponge and said cylindrical surface;

an angle bracket for directly supporting and stabilizing said sponge along substantially its full length, said actuating means including at least one fluid cylinder unit, and fluid pressure means to operate said cylinder unit, said cylinder unit directly supporting said angle bracket and said sponge; and first disengageable fastener means for mounting said sponge to said angle bracket; and second disengageable fastener means for mounting said spray tube means directly to said sponge, whereby said sponge and said spray tube are moved together by said cylinder unit when said first and second fastener means are engaged, said sponge and said spray tube means being releasable for cleaning from said angle bracket as an integral unit by disengagement of said first fastener means and releasable from each other by disengagement of said second fastener means.

2. The cleaning attachment of claim 1 wherein said orifices are formed on said spray tube means in two sets, alternate ones of said orifices forming a set, said one set being directed toward said sponge unit and said other set being directed toward said cyindrical surface.

3. The cleaning apparatus of claim 1 wherein is further provided upstanding shield means mounted adjacent said sponge unit to intercept flying particles from said surface.

4. The cleaning apparatus of claim 1 wherein said actuating means includes air cylinders supporting said sponge unit, control means for said actuating means, said control means also being operative to connect said solvent source to said spray tube means, and said control means includes air pressure means for simultaneously operating said cylinders and pressurizing said solvent source.

5. The cleaning apparatus of claim 4 wherein is further provided an additional cleaning apparatus and blanket cylinder, and said control means includes select switch means to operate one or both cleaning apparatus.

* * * * *